US005962820A

United States Patent [19]

LePoutre

[11] Patent Number: 5,962,820

[45] Date of Patent: Oct. 5, 1999

[54] SOUND SUPPRESSING DEVICE FOR CLEAN AIR TUBE

[75] Inventor: Edmond Pol Jean LePoutre, Curitiba, Brazil

[73] Assignee: Westaflex Tubes Flexiveis, Ltda., Parana, Brazil

[21] Appl. No.: 08/881,618

[22] Filed: Jun. 24, 1997

[30] Foreign Application Priority Data

Jul. 1, 1996 [BR] Brazil ..... 9603046

[51] Int. Cl.[6] ..... F02M 35/00

[52] U.S. Cl. ..... 181/229; 55/DIG. 30; 123/198 E

[58] Field of Search ..... 181/224, 225, 181/227, 228, 229, 230, 204; 55/276, DIG. 30; 123/198 E

[56] References Cited

U.S. PATENT DOCUMENTS

| | | | |
|---|---|---|---|
| 4,483,413 | 11/1984 | Ohashi | 181/224 |
| 4,619,344 | 10/1986 | Uesugi et al. | 181/229 |
| 5,548,093 | 8/1996 | Sato et al. | 181/224 |
| 5,571,242 | 11/1996 | Demorest | 181/228 |
| 5,649,986 | 7/1997 | Mueller | 123/198 E |

*Primary Examiner*—Khanh Dang
*Attorney, Agent, or Firm*—Hughes Hubbard & Reed LLP; Ronald Abramson; Peter A. Sullivan

[57] ABSTRACT

A modable acoustic tubular device is coupled internally in the clean air tube of a vehicle engine inlet assembly. The moldable acoustic tubular device is made of an acoustic absorbing material provided with controlled porosity or a set of acoustic materials having controlled porosity, superimposed and glued to each other. The tubular device has the shape thereof predetermined pursuant to the internal characteristics of the conventional clean air passage tube which is made of rubber or plastic and which interconnects the air filter and the carburetor of a vehicle engine. The tubular device absorbs sound waves caused by the inlet noises. The device is applied internally inside the inlet tube by gluing or other adhesion and may remain integral with the inside of the tube or be removable therefrom. The acoustic tubular device is capable of being applied partially or totally along the inside of the inlet tube, also with an end thereof extending or not beyond the limit of the tube in the latter's coupling with the nozzle of the air filter's clean air compartment.

9 Claims, 2 Drawing Sheets

SOUND SUPPRESSING DEVICE FOR CLEAN AIR TUBE

FIELD OF THE INVENTION

The present invention relates to a moldable, acoustic tubular device made of sound-absorbing material or a set of sound-absorbing materials, which has the shape thereof predetermined according to the internal characteristics of the conventional clean air tube made of rubber or plastic that interconnects a vehicle's air filter and carburetor, wherein the acoustic tubular device is internally coupled in the clean air tube.

BACKGROUND OF THE INVENTION

As is known in the automotive industry, there are at present acoustic devices located in the inner part of a vehicle engine's air filter (10), which can be, for example, the known sound-reducers or truncated-cone sound reducers, made of plastic or metal, which are generally coupled in circular apertures (1-A1, 2-A1 as shown in FIG. 1 herein) made respectively in one side of the upper compartment (1) and the lower compartment (2) of the air filter (10). The air filter element (3) remains pressed between the two compartments (1, 2) and the internal supports for the air filter element (3), as can be seen on FIG. 1 annexed hereto, which shows a lateral cross-section of an inlet assembly, showing the conventional air filter.

There are also conventional acoustical devices located in the outer part of the air filter (10), which can be for example, tubes or boxes that control the air input to the engine and which are arranged upstream of the air filter (10), coupled to the nozzle (1-A) of the dirty air inlet of the upper compartment (1) of air filter (10).

The above mentioned conventional acoustic devices have the scope of reducing the inlet noises. It can be seen, however, that the conventional clean air passage tube (5) made of rubber or plastic, which is coupled to the clean air exit nozzle (2-A) of the lower compartment (2) of air filter (10) and to the carburetor nozzle (6) is merely a leak proof tube (5) that ensures a perfect seal for the conducted air. However, the fact that the tube (5) is made of rubber or plastic causes it to transmit the engine noise, an aspect that is evidence of a technological short coming. Since the clean air passage tube (5) interconnects the air filter (10) and the carburetor (6), it is an integral part of the vehicle engine inlet assembly.

OBJECTS OF THE INVENTION

The moldable acoustic tubular device of the present invention was conceived and designed to solve the technical noise communicating deficiency relating to the aforementioned clean air passage tube.

SUMMARY OF THE INVENTION

In keeping with these objects and others which may become apparent, the present invention includes an acoustic, internal, tubular lining having a predetermined shape, in accordance with the internal characteristics of the clean air passage tube connecting the air filter to the carburetor of a vehicle engine.

DESCRIPTION OF THE DRAWINGS

The present invention can best be understood in conjunction with the accompanying drawings, in which.

DETAILED DESCRIPTION OF THE DRAWINGS

Figure 1:
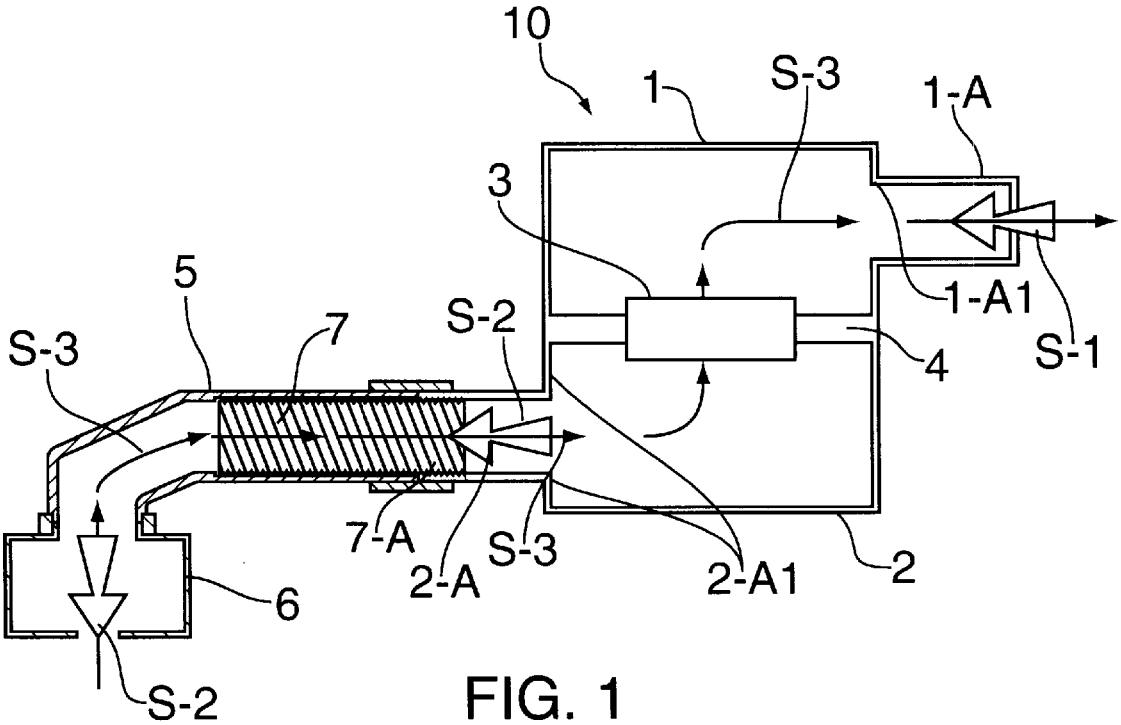
FIG. 1 is a cross sectional view of an air intake assembly of an engine showing the moldable acoustic device of the present invention.
Figure 2:
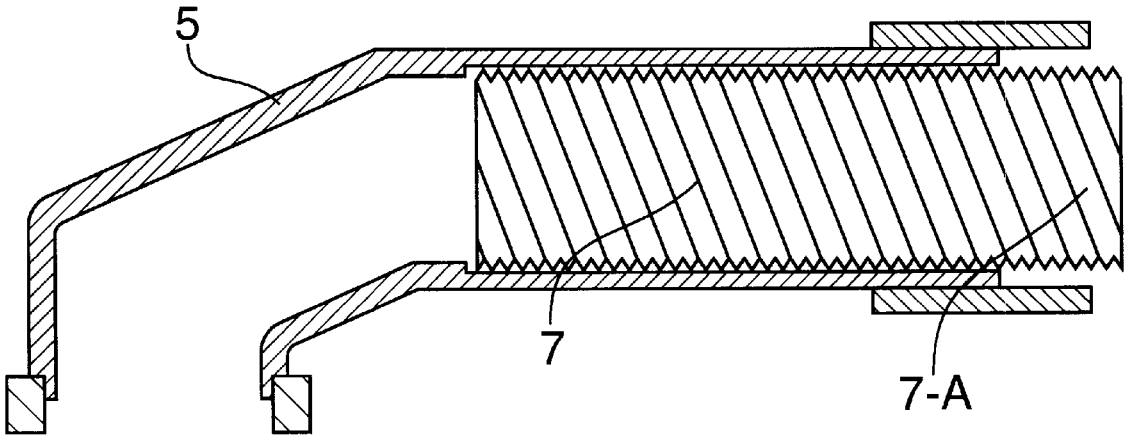
FIG. 2 is a close up cross sectional view of one embodiment of the present invention.
Figure 3:
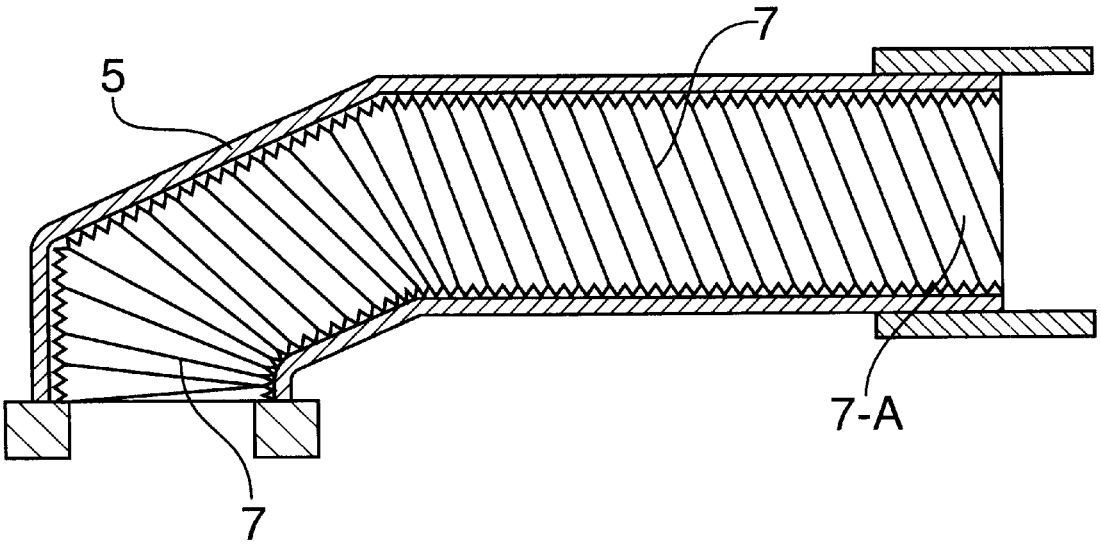
FIG. 3 is a close up cross sectional view of another embodiment of the present invention.

As shown in FIGS. 1–3, the present invention includes an acoustic tubular device (7) which is applied internally by adhesive or otherwise, either removable from or integral with an inner portion of tube (5) connecting air filter (10) with carburetor (6). The acoustic tubular device (7) is capable of being applied either partially or totally along the inner portion of tube (5) with an end thereof extending beyond the outer limit of the tube (5) in the coupling thereof to the clean air exit nozzle (2-A) of air filter (10).

As shown in FIG. 1, showing an inlet assembly, the moldable acoustic tubular device (7) is applied inside the clean air passage tube (5) by partial coupling. It is noted that in this example of an application of the acoustical tubular device (7), also shown separately in FIG. 2, there is shown a lateral cross-section of tube (5), having the moldable acoustic device (7) internally coupled thereto. The tube (7) is given a straight tubular shape. However, it can be observed that one end (7-A) of the moldable acoustic device (7) extends beyond the limit of the mouth of tube (5) and penetrates its end (7-A) inside the lower compartment (2) of air filter (10), as well as clean air exit nozzle (2-A) of the conventional air filter (10), which is able to penetrate inside the clean air compartment (2) of air filter (10).

FIG. 1 also shows the sequence of aspiration of dirty air—shown by larger arrows (S-1). Accordingly, the air drawn by dirty air inlet nozzle (1-A) passes through the upper compartment (1) and through the filtering element (3). The already cleaned air then enters the lower compartment (2) of air filter (10), and the clean air flow—shown by larger arrows (S-2) passes through the clean air exit nozzle (2-A) and subsequently through the inner portion of the acoustic tubular device (7) and the clean air passage tube (5) and thence to the vehicle engine's interior, through the carburetor (6). Thereby, simultaneously and inversely to the trajectory of dirty air, as indicated by arrows 5-1, described above, a sequence of inlet noises takes place by means of sound waves—shown in sequence by bold arrows (S-3), which are initially absorbed by the acoustic tubular device (7) and subsequently absorbed by the conventional acoustic and internal devices coupled inside the lower (2) and upper (1) compartments of air filter (10). These sound waves are ultimately absorbed by the conventional external acoustic devices coupled around and outside the dirty air inlet nozzle (1-A).

It should be pointed out that, depending on the acoustic attenuation desired for the inlet assembly, the acoustic tubular device (7) may entirely or partially dispense with the utilization of the above mentioned conventional acoustic devices.

FIG. 3 annexed hereto is a lateral cross-sectional view of the conventional clean air passage tube (5), having the moldable acoustic tubular device (7) applied by total coupling to the interior thereof. It is noted that in this example of application of the moldable acoustic device (7), preferably a tubular shape is provided in accordance with the internal and broken characteristics of the conventional tube (5). It is further noted that in this example of application, the end (7-A) of device (7) does not extend beyond the limit of the mouth of tube (5) whereby, as a result, the end (7-A) of acoustic device (7) does not penetrate the inside of the clean air exit nozzle (2-A) of the conventional air filter, as it could then penetrate nozzle (2-A) and the clean air compartment (2).

It should be explained that the moldable acoustic tubular device (7) is manufactured of an acoustic, absorbing material provided with pores, or manufactured with a set of acoustic materials, all having controlled porosity.

As an example, in the case where only one acoustic absorbing material for the manufacture of the moldable acoustic tubular device (7), this is preferably a substrate of a porous, non-woven polyester.

Also as an example, in the case where a set of acoustic materials are employed in the manufacture of the moldable acoustic tubular device (7), this set of materials may be porous paper, perforated aluminum and cotton tissue superimposed to and glued to each other. For the manufacture of the moldable acoustic tubular device (7) there is employed a thermo-pressing machine, or a mold, or a circular weaving machine, or another appropriate manufacturing process.

The beneficial technical effect caused by the moldable acoustic tubular device (7) is that of absorbing the sound waves. It has been observed that in the conduct of experiments, the moldable acoustic device (7) shows excellent acoustic conditions, whereby when an engine intake assembly employs the device (7) inside the clean air passage tube (5), there is a significant decibel gain.

It is noted that other modifications may be made to the present invention without departing from the scope of the invention, as noted in the appended claims.

I claim:

1. A sound suppressing device for an engine inlet assembly including carburetor or fuel injection system's air intake, said device comprising:

a filter filtering a clean air flow of the intake air flowing along a path and having a housing;

a clean air nozzle located along the path downstream from the filter and being in flow communication therewith;

a clean air tube located downstream from and being in flow communication with said clean air nozzle, said clean air tube terminating immediately upstream from the engine inlet assembly and being formed with an inner peripheral surface traversed by said clean air flow; and a sound suppressing device made of a porous sound absorbing material and having an outer face juxtaposed with the inner peripheral surface of the clean air tube.

2. The device defined in claim 1 wherein said sound suppressing device is formed with at least one layer.

3. The device defined in claim 2 wherein said sound suppressing device is formed with at least one another layer, said one and one other layers being interposed with one another.

4. The device defined in claim 1 wherein said sound suppressing device is removably attached to the inner peripheral surface of the tube by a means selected from the group consisting of gluing means, heat pressing means, molding means, weaving means and mechanical means, said outer face of the sound suppressing device extending complimentary the inner surface of the clean air tube.

5. The device defined in claim 1 wherein said outer face of the sound device has an upstream end thereof extending into the clean air nozzle.

6. The device defined in claim 1 wherein said outer face of the sound device has an upstream end extending into said filter housing.

7. The device defined in claim 1 wherein a downstream end of said outer face of the sound device terminates upstream from a downstream end of the tube.

8. The device defined in claim 1 wherein said air clean tube is made of a material selected from the group consisting of rigid and flexible materials.

9. A sound suppressing device for an engine inlet assembly including carburetor or fuel injection system's air intake, said device comprising:

filter means for filtering a clean air flow of the intake air flowing along a path and formed with a housing, a clean air nozzle located along the path downstream from the filter means and being in flow communication with the housing;

a clean air tube located downstream from and being in flow communication with said clean air nozzle, said clean air tube terminating immediately upstream from the engine inlet assembly and being formed with an inner peripheral surface traversed by said clean air flow; and a sound suppressing device made of a porous sound absorbing material and having an outer face juxtaposed with the inner peripheral surface of the clean air tube, said sound device extending from said tube and terminating upstream from an upstream end of the air tube.

* * * * *